United States Patent [19]

Lorang

[11] 4,167,268

[45] Sep. 11, 1979

[54] GOLF PUTT TRAINING APPARATUS

[76] Inventor: Walter R. Lorang, 2239 W. Maple Rd., Walled Lake, Mich. 48088

[21] Appl. No.: 805,716

[22] Filed: Jun. 13, 1977

[51] Int. Cl.[2] ..... A63B 69/36

[52] U.S. Cl. ..... 273/163 A; 273/183 E

[58] Field of Search ..... 273/77 R, 163 R, 163 A, 273/164, 183 D, 183 E, 193 R, 194 R, 194 A, 186 R, 186 A, 162 R; 33/233, 263, 265

[56] References Cited

U.S. PATENT DOCUMENTS

| | | | |
|---|---|---|---|
| D. 211,100 | 5/1968 | Baker | 273/164 X |
| 1,091,186 | 3/1914 | Brown | 273/183 E X |
| 1,433,150 | 10/1922 | Reach | 273/164 |
| 1,652,404 | 12/1927 | Graveure | 273/164 |
| 2,003,951 | 6/1935 | Pepin | 273/164 |
| 2,669,782 | 2/1954 | Turner | 33/233 X |
| 2,771,678 | 11/1956 | Hansen | 273/183 E X |
| 2,898,109 | 8/1959 | Williams | 273/163 R |
| 3,030,708 | 4/1962 | Daniel | 33/233 |
| 3,033,574 | 5/1962 | Partridge | 273/183 D |
| 3,198,525 | 8/1965 | Smith | 273/163 R |
| 3,292,928 | 12/1966 | Billen | 273/163 R |
| 3,298,693 | 1/1967 | Eisenberg | 273/194 R X |
| 3,410,562 | 11/1968 | Lefleur | 273/162 R |
| 3,549,300 | 12/1970 | Pelz | 273/164 X |
| 3,595,582 | 7/1971 | Chapman | 273/164 X |
| 3,876,211 | 4/1975 | Caligiuri | 273/164 X |
| 3,880,430 | 4/1975 | McCabe | 273/164 X |
| 3,951,415 | 4/1976 | Stuart | 273/163 A X |
| 4,053,160 | 10/1977 | Salata | 273/186 A |

*Primary Examiner*—Richard J. Apley

[57] ABSTRACT

The apparatus enables a golfer to visually determine that he has the face of his putter normal to the target line and that he is stroking his putter along a straight line with the face of his putter at a right angle relative to the target line by visually indicating conformance thereto or deviation therefrom. A gauge is mounted on the shaft of the putter spaced above the club head. The gauge extends outwardly from the golfer and lies in his line of vision from his eye to the ball and the club head. The gauge is set on the shaft at the same angle as the putting face. The gauge has two like side members aligned on either side of the putter face and/or an additional central member aligned with the putter face. The golfer aligns the putter face at the ball between the side members and/or the central member in visual alignment. He maintains the visual alignment prior to and during his entire putting stroke. If alignment is maintained, he has stroked his club against the ball along a straight line and at a right angle to it. If the alignment is not maintained he has turned the shaft angularly, stroked on a curve, stroked on a non-target line, and/or a combination thereof.

10 Claims, 23 Drawing Figures

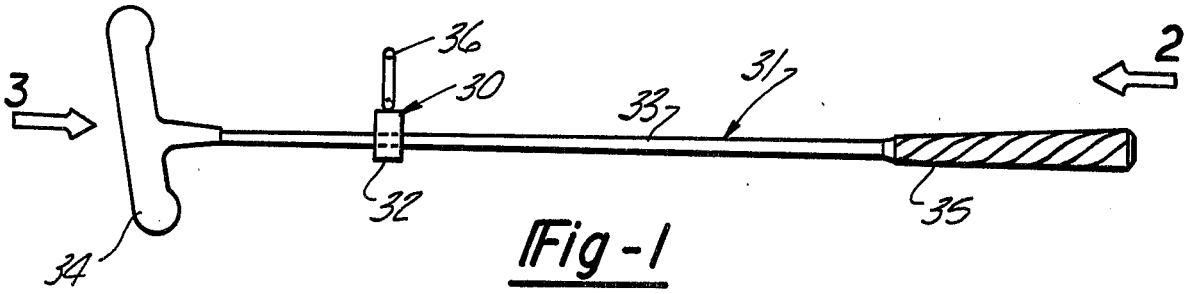
Fig-1
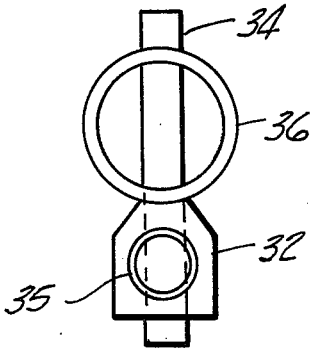
Fig-2
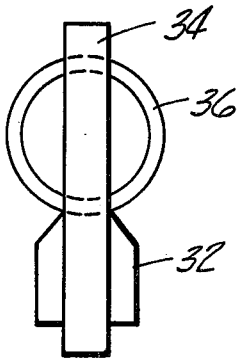
Fig-3
Fig-7
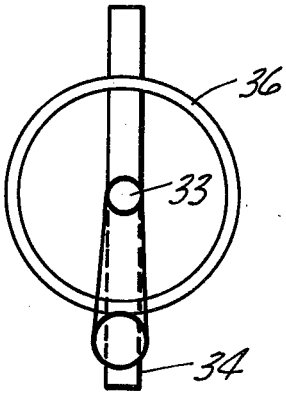
Fig-8
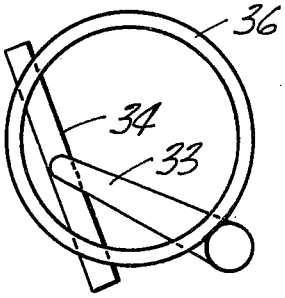
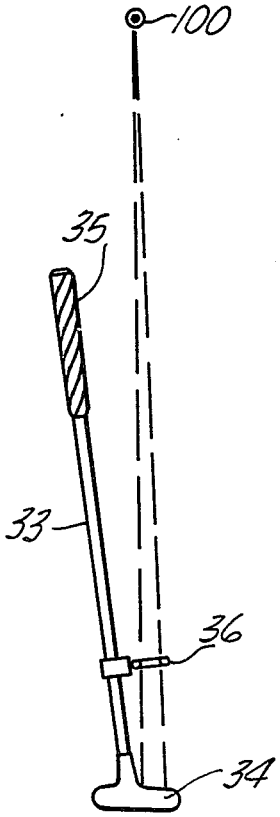
Fig-4
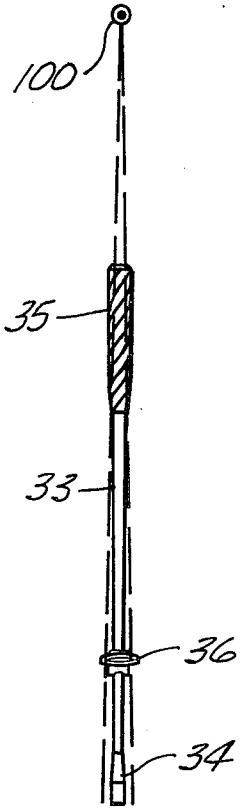
Fig-5
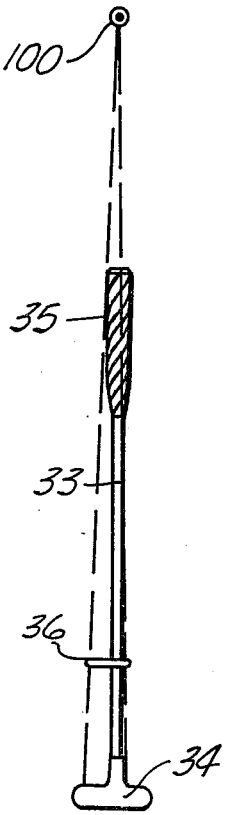
Fig-6
Fig-9
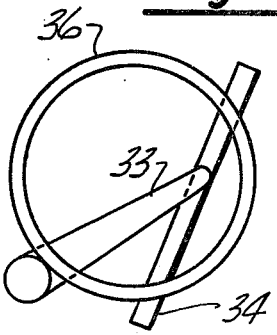

Fig-10
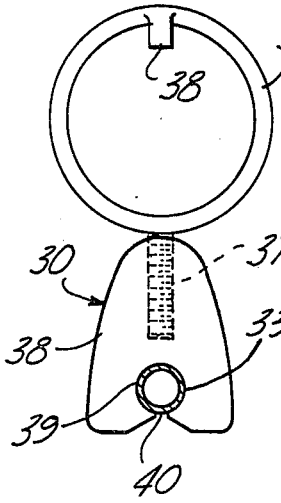
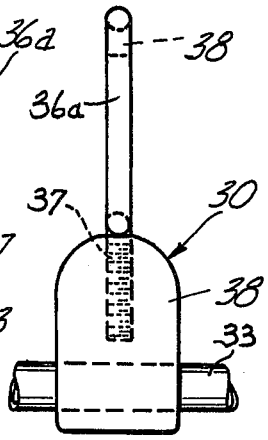
Fig-11
Fig-12
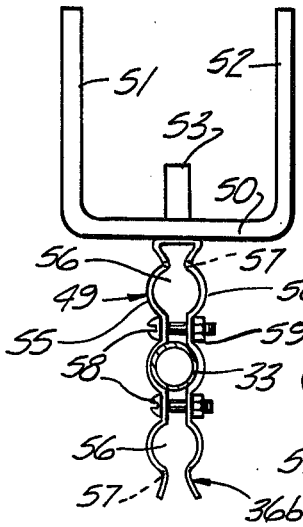
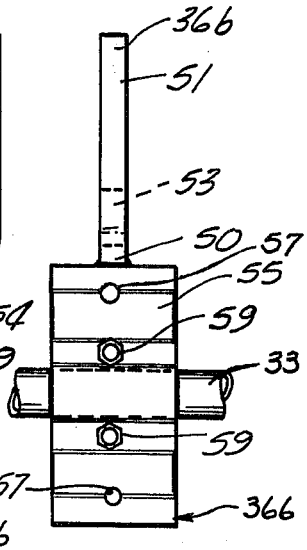
Fig-13
Fig-15
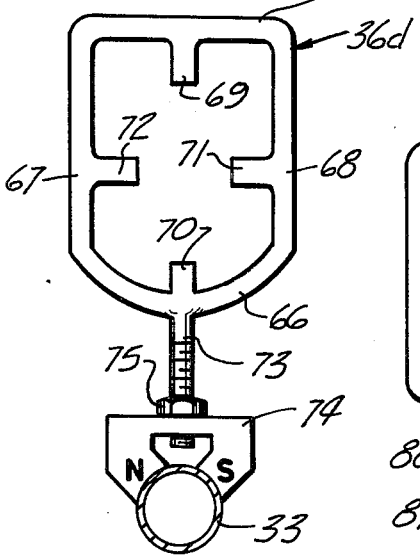
Fig-16
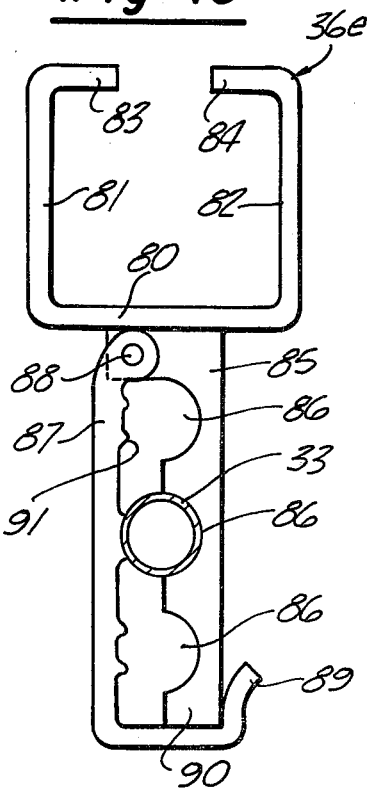
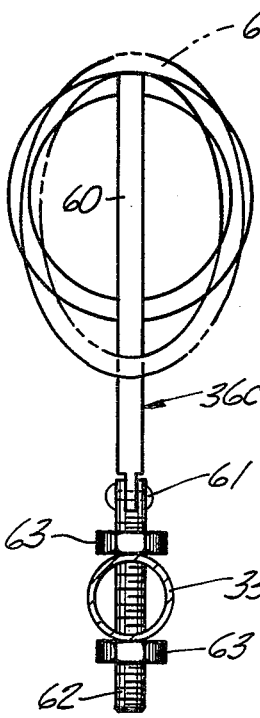
Fig-14

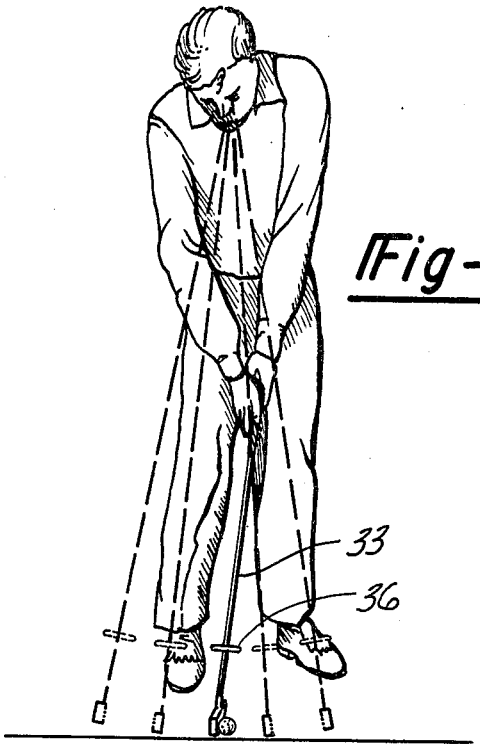
Fig-17
Fig-21
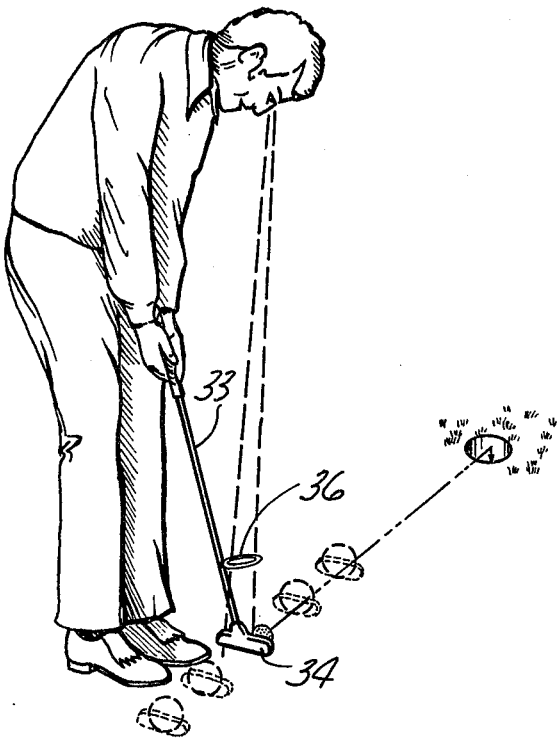
Fig-18
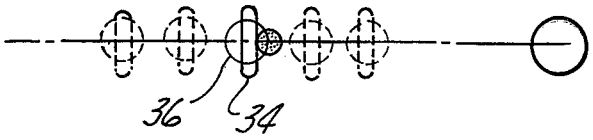
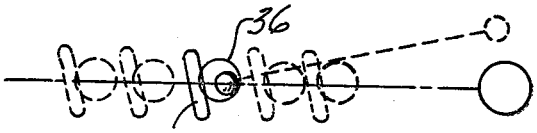
Fig-19
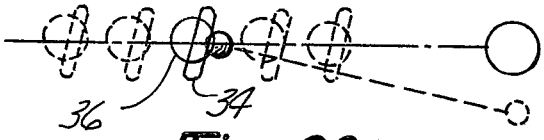
Fig-20
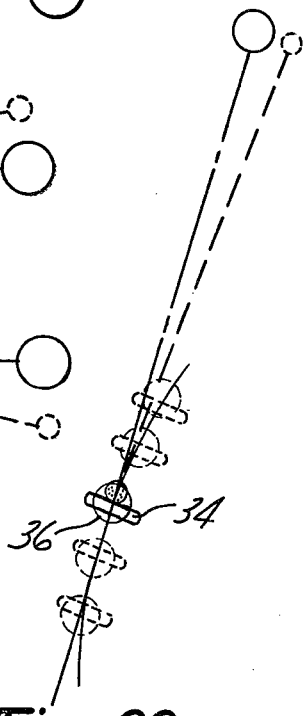
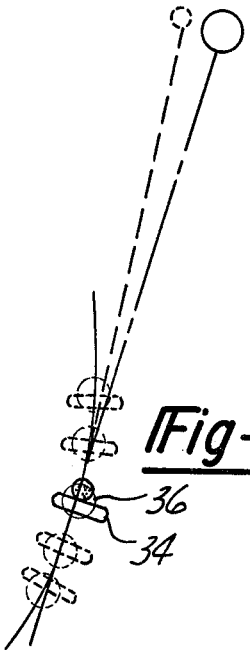
Fig-23
Fig-22

GOLF PUTT TRAINING APPARATUS

BACKGROUND OF THE INVENTION

Putting is about half the score in par golf and thus the basic bread and butter of a low score game. The most difficult and elusive element of the stroke is to move the club head on a straight line with the putter face at a right angle to it. The putter must move in a straight line and the face must be kept at a right angle to it throughout the entire stroke—back stroke, fore stroke, at contact with the ball, and during follow through. Small deviations result in magnified inaccuracies in ball travel toward the target.

The golfer must first estimate what he visualizes to be the target line. He then must establish the face of the putter at a right angle to this line. He then must stroke the club against the ball in a straight line along the target line. And he must keep the putter face at a right angle to the line during the entire stroke.

The duffer, average, scratch and pro golfer can determine the target line in his stance position or at least a line reasonably close to a true line for all practical purposes. Some golfers at stance have difficulty in accurately locating the putter face normal to the envisioned line. Most golfers have difficulty in maintaining the putter face at a right angle to the envisioned line during the entire stroke. But all golfers have difficulty in stroking the putter against the ball on a straight line.

The non-straight line stroke is the element resulting in greatest error. And the non-straight line stroke persists because the golfer has no way of measuring the straight line accuracy of his stroke.

SUMMARY OF THE PRESENT INVENTION

It is not much help to the golfer to tell him to stroke the club in a straight line against the ball while holding the putter face normal to that line. However, it is a great aid to the golfer to provide apparatus which tells him when he is stroking the club against the ball in a straight line with the putter face normal to that line and when he is not; - particularly when he is not because this informs him of his error. We learn from mistakes, but only when we know what the mistake is.

The present invention provides the golfer with a gauge which visually advises him of correct putter face angulation on initial stance and during stroking the putt and which dramatically emphasises deviation from correct putter face angulation at the initial stance and during stroking. The present invention shows the golfer if he strokes the club along a straight line and when he deviates from stroking the club along a straight line.

The golfer initially establishes a line of sight from his eye to the face of the putter at the ball. The gauge is mounted on the club shaft between the head and the grip and extends from the shaft away from the golfer into his stated line of sight. In an exemplary embodiment of the invention, the gauge has a central member overlying the club head aligned with the putter's face. In other exemplary embodiments of the invention, the gauge has side members spaced sidewise out from and overlying the club head defining a center therebetween. The putter face or head is aligned centered of the gauge at the ball.

If the golfer sets the putter centered on the gauge with the putter normal to the envisioned target line and maintains the putter visually centered on the gauge during his stroke, he will stroke the ball on a straight line and the ball will travel along his envisioned target line. If his envisioned target line is true, the ball will advance directly toward the hole. If his envisioned target line deviates from true, the ball will travel the line of deviation and this deviation is usually small if the putter face is first set normal to the line and is stroked against the ball on a straight line path during the entire putt.

If the golfer does not visually set the putter centered with the gauge and does not maintain it visually centered during the stroke he contacts the ball with the face of the putter at an off-angle from normal to the envisioned target line causing deviation. The failure to stroke along a straight line causes the greatest deviation and is the most common fault in putting and the most difficult to recognize and correct.

It is thus an object of the invention to provide the golfer with a gauge which visually indicates to him the initial normal angulation of the putter face to the envisioned target line.

It is an object of the invention to provide the golfer with a gauge which visually indicates to him that he has or has not moved his putter on a straight line path during his stroke.

It is an object of the invention to provide the golfer with a gauge which visually indicates to him whether or not he has moved his putter in a straight line path against the ball with the putter face normal to the straight line path of his stroke.

After a golfer has learned to stroke the putter in a straight line, he has mastered the most difficult aspect of putting and he can then perfect other aspects with a much greater chance of improving as he has the basic fundamental—the sine que non of putting—stroking the putter in a straight line path.

An embodiment of the gauge of the invention has a linear member on the shaft of the putter above the head which extends outwardly away from the golfer so as to overlie the club in alignment with the putting face. Principal embodiments of the gauge of the invention have side members which lie on the target side and on the off-target side of the head of the putter.

The gauge is closer to the putter head than to the eye of the golfer. The gauge swings with the putter head in stroking motion but the eye remains stationary. If the golfer strokes along a straight line, the visual aspect of the gauge and the putter remain the same during the entire stroke.

The structure, operation and result of the invention will be more apparent and understood more fully from the hereinafter detailed description of the illustrated embodiments taken in connection with the accompanying drawings now described.

DESCRIPTION OF THE DRAWINGS

FIG. 1 is a side elevational view of a putter equipped with a gauge of the invention mounted on the shaft spaced from the club head.

FIG. 2 is a top end elevational view of the apparatus seen in FIG. 1 taken in the direction of the arrow 2.

FIG. 3 is a bottom end elevational view of the apparatus seen in FIG. 1 taken in the direction of the arrow 3.

FIG. 4 is a reduced side elevational schematic view of the apparatus of FIGS. 1–3 showing the apparatus in a playing position, showing the eye of the golfer diagrammatically, and showing the line of sight from the golfer's eye past the gauge to the club head in broken lines.

FIG. 5 is a face elevational view, similar to FIG. 4, of the apparatus seen in FIG. 4 with the club head held normal to the target line.

FIG. 6 is a view similar to FIG. 5, showing the club head not lying normal to the target line.

FIG. 7 is an enlarged diagrammatic view of the putter head, gauge, and club shaft as seen by the golfer such as in FIGS. 4 and 5 with the putter face normal to the target line and the gauge centered on the club head.

FIG. 8 is a view similar to FIG. 7, showing the putter face not normal to the target line with the gauge closed on one side and opened on the other side as seen by the golfer.

FIG. 9 is a view similar to FIG. 8, showing the putter head off normal angulation in the opposite direction to that seen in FIG. 8.

FIG. 10 is an enlarged top plan view of the round ring gauge and mounting as seen in FIGS. 1–9, showing the club shaft in cross-section and the threaded extensible and retractable connection between gauge and mounting in broken lines and additionally showing an axial centering tab on the gauge.

FIG. 11 is a side elevational view of the device seen in FIG. 10, showing the shaft in broken lines and foreshortened; alternatively the figure shows the gauge of FIG. 10 turned 90° from its position seen in FIG. 10 for use as a single member gauge aligned on the putter face.

FIG. 12 is a plan view of an angular gauge having an axial centering tab and mounting attached thereto which is extendibly adjustable to locate the gauge at various distances from the shaft and showing the shaft in cross-section.

FIG. 13 is a side elevational view of the apparatus seen in FIG. 12, showing the shaft in broken lines and foreshortened.

FIG. 14 is a plan view of a single member bar gauge with an extendibly adjustable threaded connection to the club shaft, showing the shaft in cross-section, and having a hinge connection for locating the gauge in the use position and locating it out of use position and indicating in broken lines its combination with a two sided member or oval ring gauge.

FIG. 15 is a plan view of a combination curved and angular gauge having two axial centering tabs and two side centering tabs, attachment by a magnet to the club shaft, a threaded connection to the magnet for adjustment of extension, and showing the shaft in cross-section.

FIG. 16 is a plan view of an angular gauge having two side centering tabs, a snap-lever mounting having extension positions, and showing the shaft in cross-section.

FIG. 17 is a diagrammatic view of a golfer, a putter, a gauge on the putter, a golf ball, a hole, a target line, with the putter lying normal to the line at the ball, showing the line of sight of the golfer past the gauge to the putter face in broken lines, and showing the various back and fore strokes positions of the putter in broken lines.

FIG. 18 is a diagrammatic plan view as seen by the golfer of the ball, hole, target line, gauge and putter head as shown in FIG. 17, showing the putter face normal to the target line and the putter stroking on a straight line with the gauge centered at all times on the club head.

FIG. 19 is a diagrammatic plan view, similar to FIG. 18, showing the putter face off-normal angulation to the target line in one angular direction.

FIG. 20 is a view, similar to FIGS. 18 and 19, showing the putter face off-normal angulation in the other angular direction.

FIG. 21 is a perspective view from the off-target side of a golfer, showing a golfer, putter, gauge, ball, target line, showing the putter face normal to the target line and stroked on a straight line illustrating the various positions of the putter during the stroke in broken lines, and showing the golfer's line of sight in broken lines.

FIG. 22 is a diagrammatic plan view of the putter, ball, hole, target line, and a stroke line varying relative to the target line in one direction, and showing the various positions of the putter in broken lines during the stroke; and FIG. 23 is a view similar to FIG. 22, showing the stroke line varying relative to the target line in a different direction.

DETAILED DESCRIPTION OF THE ILLUSTRATED EMBODIMENTS

Referring now to the drawings wherein like reference numerals refer to like and corresponding parts throughout the several views, the novel Golf Putt Training Apparatus disclosed therein to illustrate exemplary embodiments of the invention comprise a gauge assembly 30 mounted on a putter 31, FIGS. 1–11. This embodiment is used to describe the invention for the reason that it lends itself to more clearly showing the operation of the invention in the drawings and to understanding in the written description.

The gauge assembly 30 consists of a mounting means 32 attachable to the shaft 33 of the putter 31 at a point between the head 34 and the grip 35 of the putter 31. The mounting means 32 may be a rubber or plastic block 38 which has an aperture 39 for receiving the club shaft 33 and a slot 40 leading to the aperture 39. The club shaft 33 is forced through the slot 40 into the aperture 39 under compression and this frictionally holds the block 38 on the shaft 33 in adjusted position. A gauge 36 is supported by the mounting means 32. As seen in FIG. 10, the gauge 36 - 36A is attached to a threaded stud 37, which allows the gauge 36 - 36A to be adjusted close to or out from the mounting means 32 to locate the gauge 36 - 36A further from the shaft 33 or closer to the shaft 33 to position the gauge 36 - 36A in the line of sight of the golfer as he looks at the ball. This makes the gauge adjustable to the line of sight of golfers who hunch over the ball and for those who stand away from the ball. Gauge 36 is a plain ring, FIGS. 1–9, and gauge 36A, FIGS. 10–11, has a centering tab 38. The gauge 38 may be positioned at 90° to its position seen in FIG. 10 so that it gives the golfer the visual aspect of the gauge 36 as seen in FIG. 11. This enables the gauge 36 to be used as a centering gauge relative to the putter face.

The gauge 36B, FIGS. 12–13, is open ended rectangular in shape and has a base 50 which is attached to the mounting means 49. Side arms 51 and 52 extend from the base 50. A centering tab 53 extends from the base 50 and lies between the arms 51 and 52. The mounting means 49 has two legs 54 and 55 which have a serpentine configuration forming partial sockets 56 for clamping on the shaft 33. The legs 54, 55 have apertures 57. Bolts 58 lie in the apertures 57 adjacent the shaft 33 and nuts 59 on the bolts 58 draw the legs 54 and 55 together toward one another to grip the shaft 33.

The gauge 36C, FIG. 14, has a central member or centering bar 60 which lies parallel to the face of the putter. A hinge connection 61 supports the bar 60 on the mounting. The mounting includes a threaded stud 62 which lies in a hole drilled in the shaft 33 of the putter. Lock nuts 63 secure the stud 62 in adjusted position. A ring 64 indicated in dotted lines may be attached to the centering bar 60. The centering bar 60 may be used singly and/or in combination with the ring 64 or any of the other gauges having side members.

The gauge 36D, FIG. 15, has a rectangular outer end 65, a curved inner end 66, straight sides 67 and 68, outer and inner centering tabs 69 and 70, and side centering tabs 71 and 72. A threaded leg 73 leads from the curved end 66. A magnet 74 is threaded on the leg 73. A lock nut 75 on the threaded leg 73 jams against the magnet 74 securing the leg 73 in adjusted extended position. The magnet 74 adheres to the shaft 33 as positioned.

The gauge 36E of FIG. 16 is partially open ended and rectangular in shape. A base 80 on the gauge 36E has two arms 81 and 82. Centering tabs 83 and 84 on the ends of the arms 81, 82 extend toward center. The mounting means includes a block 85 attached to the base 80 of the gauge 36E. Arcuate or half-round sockets 86 are formed in the block 85. The shaft 33 is positioned in a selected socket 86. An arm 87 is hinged at 88 on the block 85 and has a hooked clamp end 89 remote from the hinge point 88 which fits around the end 90 of the block 85. Abutments 91 are formed on the arm 87 opposite the sockets 86 in the block 85. The shaft 33 is locked in a selected socket 86 by the arm 87 and the abutments 91.

In use and operation, when the golfer takes his putting stance he looks down at the ball through the gauge, such as the gauge 36, FIGS. 4 and 5. The lines of sight from his eye 100 extend past and through the gauge 36 to the ball and the club head 34. He sees the club head centered in FIGS. 4 and 5 and normal to the target line. In FIG. 6, he has turned the putter head 34 off normal to the target line in one direction and he sees the putter head 34 lying off center relative to the gauge 36 and cutting across one side of the gauge 36 as seen in FIGS. 6 and 8. FIG. 9 illustrates what the golfer sees when he turns the club off normal in the other direction.

It should be understood that the eye 100 remains stationary and that it is recognized that the gauge 36 turns with the club head 34. FIGS. 7, 8, and 9 show what the golfer sees and it is to be noted that the gauge 36 clearly indicates the fact that the putter face lies normal, FIG. 7, and that it does not lie normal, FIGS. 8 and 9, to the target line.

It is also to be understood that the target line described is that which is envisioned by the golfer. His envisioned target line may be on the actual ball-to-hole line or it may vary therefrom. Thus at the initial stance, the gauge 36 positions the putter face of the head 34 at the ball normal to the envisioned target line and gives the golfer the basic "normal to target" putter face position.

The golfer now should stroke the putter in a straight line through the ball while holding the putter face normal to the target line. To do this to best advantage, the golfer should move the club from his shoulders, FIG. 17. If the golfer does this, his line of sight past and through the gauge 36 shows the putter face of the head 34 in the same position relative to the guage 36 during his entire stroke, FIG. 18. FIG. 18 shows this with the putter face normal to the target line. FIGS. 19 and 20 show what the golfer sees relative to the gauge 36 if he strokes his club along the target line but lets the putter face of the head 34 turn off normal angulation to the target line.

FIG. 21 shows the golfer stroking the club head in a straight line along the envisioned target line with the putter face held normal to the target line the same as shown in FIGS. 17 and 18 and the gauge 36 shows the golfer the same image of the putter face and/or the head 34 in all positions of the stroke.

FIG. 22 shows a curved or non-straight line stroke of the putter by the golfer and what he sees relative to the gauge 36 during his stroke. It is to be noted that on his back stroke the putter face moves progressively closer to the target side of the gauge. On his forestroke, the reverse occurs and the putter face looks normal to the ball and the target at impact. On his follow-through, the putter face moves progressively closer to the off-target side of the gauge 36. FIG. 22 illustrates the situation when the putter is stroked on a curve with the golfer located outside the curve. FIG. 23 illustrates the situation of a non-straight line stroke when the golfer is standing inside the curve. While consistent curve variations are shown, it will be understood that in combinations of the two curves shown, that the gauge will show the golfer substantially the same variaions of his club to the gauge. Thus a stroke on a snake-like curve will move the sides of the gauge similarly to the putter and present a similar non-straight line visual indication to the golfer.

It is to be noted that the proper normal position of the club head to the target line is individually shown in FIGS. 17 and 18 with the golfer stroking the club in a straight line. This is also true of FIG. 21. Thus these figures illustrate the proper manner of stroking the putter on a straight line with the putter face normal to the target line.

FIGS. 19 and 20 and FIG. 22 show two errors of a stroke individually. FIGS. 19 and 20 show the error of not holding the putter face normal to the target line. FIG. 22 shows the error of stroking the putter on a curve or other non-straight line. FIG. 23 shows a combination of the two errors with the putter face varying from normal to the target line and stroked on a curve or other variation from a straight line.

While various embodiments of the invention have been shown and described to illustrate the invention, it will be understood that the invention is not limited to them and is limited only by the scope of the appended claims.

I claim:

1. Gold putt training apparatus for teaching a golfer to align the face of the putter angularly in a horizontal plane normal to his envisioned target line and for teaching a golfer to move the face of the putter in a straight line path through the ball during his stroke, including, a golf putter, a gauge comprising mounting means and a sighting (means) member attachable to said putter;

said putter having a shaft and a putter head connected to the lower end of said shaft, said head lying in a horizontal plane outwardly from said shaft, said head having a putter face lying in a substantially vertical plane, said shaft leading upwardly from said head angling toward the golfer on an inclination to the vertical;

said mounting means attaching said sighting member on said shaft at a point spaced above said head;

said sighting member when attached lying substantially in a horizontal plane spaced above said head and spaced from said shaft in a location over said head so as to lie in the line of sight from the golfer's eye to the ball and said face of said putter;

said sighting member comprising a base portion attached to said mounting means;

said base portion lying transverse to said putting face of said putter head;

paired spaced distinct side members leading from said base portion extending outwardly away from the golfer thereby allowing said head to be visible therebetween;

one said side member lying spaced horizontally from the vertical plane of said putting face and the ball on the target side of said putting face and said other side side member lying spaced horizontally from the vertical plane of said putting face on the off-target side of said putting face; said side members being similarly spaced from said putting face;

said sighting member side members when said putting face is lying normal to the target line visually lying with said putting face spaced similarly between said side members;

said sighting member side members when said putting face is stroked along a straight line path toward the target visually lying with said putter face spaced similarly between said side members;

said sighting member and said putter face, when not lying normal to the target line, pivot on equal angles with pivotal angular motion of said shaft oscillating in different horizontal planes and from different off-set horizontally spaced pivot points on said vertically inclined shaft so that they visually describe different motions on the line of sight from the eye of the golfer so that they visually appear to lie dis-similarly spaced advising the golfer that said putter face does not lie normal to the target line;

said sighting member and said putter face, when not stroked on a straight line, swing on equal angles in (pendulating angular) motion but pivot on different radii on the line of sight from the golfer and from different off-set horizontally spaced points on said vertically inclined shaft so that, when said putter face is not stroked along a straight line path, they visually describe dis-similar spacing on the line of sight from eye of the golfer advising the golfer that his stroke is not along a straight line path.

2. In apparatus as set forth in claim 1, said visual (indicating) sighting member including a single centered linear bar.

3. In apparatus as set forth in claim 1, said visual (indicating) sighting member being a ring.

4. In apparatus as set forth in claim 3, at least one centering tab on said ring.

5. In apparatus as set forth in claim 1, said visual sighting member being U-shaped.

6. In apparatus as set forth in claim 5, at least one centering tab on said member.

7. In apparatus as set forth in claim 1, said visual sighting member being curvi-linear.

8. In apparatus as set forth in claim 7, at least one centering tab on said member.

9. In apparatus as set forth in claim 1, said side members on said sighting member being straight.

10. Golf putt training apparatus in combination with a golf putter for teaching a golfer to align the face of his putter angularly in a horizontal plane normal to his envisioned target line and to move the face of his putter in a straight line path through the ball during his stroke, including said putter having a shaft and a putter head connected to the lower end of said shaft, said head lying in a horizontal plane outwardly from said shaft, said head having a putting face lying in a substantially vertical plane, said shaft leading upwardly from said head angling toward the golfer on an inclination to the vertical.

a gauge comprising mounting means and sighting means;

said mounting means attaching said sighting means on the shaft of a putter spaced above the head of the putter;

said sighting means comprising dual spaced distinct visual indicating members extending from said mounting means in a plane above the head of the putter in a direction away from the golfer in superposed visually similarly spaced relationship on either side of the putting face of the putter and in the line of sight from the golfer's eye to the putter;

said visual indicating members being in proper initial alignment with the putter for putting when said visual indicating members and the putter visually appear in equally spaced relationship over their mutual visual extent therebetween;

a golfer both at his stance and during his stroke sighting on the putter past said indicating members sees said indicating members in proper initial alignment with the putter both when the putter lies normal to his envisioned target line at stance and during his stroke when the path of his stroke is on a straight line and the putter face normal thereto;

a golfer both at his stance and during his stroke sighting on the putter past said indicating members sees said indicating members out of proper initial similarly spaced alignment with the putter when the putter does not lie normal to his envisioned target line and/or during his stroke when the path of his stroke is not on a straight line.

* * * * *